US008875416B2

(12) United States Patent
Anderson et al.

(10) Patent No.: US 8,875,416 B2
(45) Date of Patent: Nov. 4, 2014

(54) LAUNDRY TREATING APPLIANCE DOOR WITH PLANAR WINDOW ELEMENT AND PROJECTION

(75) Inventors: Colin T. Anderson, Granger, IN (US); Michael K. Lindquist, Saint Joseph, MI (US); Robert J. Messersmith, South Bend, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 266 days.

(21) Appl. No.: 13/454,421

(22) Filed: Apr. 24, 2012

(65) Prior Publication Data

US 2013/0276322 A1 Oct. 24, 2013

(51) Int. Cl.
*D06F 33/02* (2006.01)

(52) U.S. Cl.
USPC ..... 34/603; 34/607; 34/610; 68/5 C; 68/18 R; 8/137

(58) Field of Classification Search
USPC ..... 34/595, 601, 603, 607, 610; 68/5 C, 5 R, 68/18 R, 19, 20; 8/137, 149, 157
See application file for complete search history.

(56) References Cited

U.S. PATENT DOCUMENTS

| | | | | |
|---|---|---|---|---|
| 3,385,085 | A * | 5/1968 | Engel | 68/18 F |
| 3,668,784 | A * | 6/1972 | Teague et al. | 34/368 |
| D525,753 | S | 7/2006 | Schoene | |
| 7,320,186 | B2 | 1/2008 | Schone | |
| 7,549,305 | B2 | 6/2009 | Yun et al. | |
| 7,559,156 | B2 * | 7/2009 | Renzo | 34/595 |
| 7,905,122 | B2 | 3/2011 | Murray et al. | |
| 8,127,464 | B2 * | 3/2012 | Schone | 34/603 |
| 2006/0260367 | A1 * | 11/2006 | Byun | 68/20 |
| 2006/0265899 | A1 * | 11/2006 | Renzo | 34/603 |
| 2007/0051012 | A1 * | 3/2007 | Schoene | 34/603 |
| 2009/0083987 | A1 * | 4/2009 | Prajescu | 34/130 |
| 2011/0023316 | A1 | 2/2011 | Schone | |
| 2011/0023559 | A1 | 2/2011 | Schone | |
| 2011/0025177 | A1 | 2/2011 | Schone | |
| 2011/0025178 | A1 | 2/2011 | Schone | |
| 2013/0276322 | A1 * | 10/2013 | Anderson et al. | 34/130 |

FOREIGN PATENT DOCUMENTS

| | | | |
|---|---|---|---|
| EP | 2287387 | A2 * | 2/2011 |
| JP | 2012075689 | A * | 4/2012 |

OTHER PUBLICATIONS

Sears Parts Direct, Outer Door, Part No. 8519326 http://www.searspartsdirect.com/partsdirectipart-number/8519326/0026/110?pathTaken=directMatch&filterPart=&pop=flush&prst=0&shdPart=8519326 Accessed January 17, 2012.

* cited by examiner

*Primary Examiner* — Steve M Gravini

(57) ABSTRACT

A laundry treating appliance treats a laundry load according to at least one cycle of operation. A rotatable drum defines a treating chamber and includes an open face through which access is provided to the treating chamber. An air system supplies air to and exhausts air from the treating chamber and includes an airflow portal adjacent the open face and in fluid communication with the treating chamber. A door includes a panel with a flat surface, the door selectively movable to prevent access through the open face, and the flat surface facing the treating chamber when the door closes the open face. A deflector extends away from the flat surface and at least partially overlies the airflow portal when the door closes the open face. The deflector deflects items in the laundry load away from the airflow portal when the door is closed.

20 Claims, 8 Drawing Sheets

LAUNDRY TREATING APPLIANCE DOOR WITH PLANAR WINDOW ELEMENT AND PROJECTION

BACKGROUND

Laundry treating appliances, such as clothes dryers, typically have an air inlet and outlet for supplying and exhausting air from a treating chamber. In some dryer configurations, the outlet to the treating chamber is located near, typically beneath, a door to the treating chamber. In some dryers, the outlet to the treating chamber defines an inlet to an air filter for removing lint and other particulates from the air in the appliance while the laundry load is dried. During a drying cycle, the tumbling action of the laundry load can cause the laundry to accumulate near either the inlet or outlet, depending on their location. For the outlet, the exhausting of airflow through the outlet, which creates a suction-type force, can further increase the likelihood that the laundry will accumulate near the outlet. In those cases where the inlet/outlet is near the door, attempts have been made to divert laundry items from the inlet/outlet by utilizing a cast glass piece attached to an inner face of the door and having a convex shape which overlies the inlet/outlet and extends somewhat into the drying chamber when the door is closed. However, such cast door glass is typically expensive to manufacture and heavy, and occupies a substantial portion of the treating chamber that could otherwise be used for drying laundry.

SUMMARY

A laundry treating appliance treats a laundry load according to at least one cycle of operation. A rotatable drum defines a treating chamber and includes an open face through which access is provided to the treating chamber. An air system supplies air to and exhausts air from the treating chamber and includes an airflow portal adjacent the open face and in fluid communication with the treating chamber. A door includes a panel with a flat surface, the door selectively movable to prevent access through the open face, and the flat surface facing the treating chamber when the door closes the open face. A deflector extends away from the flat surface and at least partially overlies the airflow portal when the door closes the open face. The deflector deflects items in the laundry load away from the airflow portal when the door is closed.

DESCRIPTION OF EMBODIMENTS OF THE INVENTION

Figure 1:
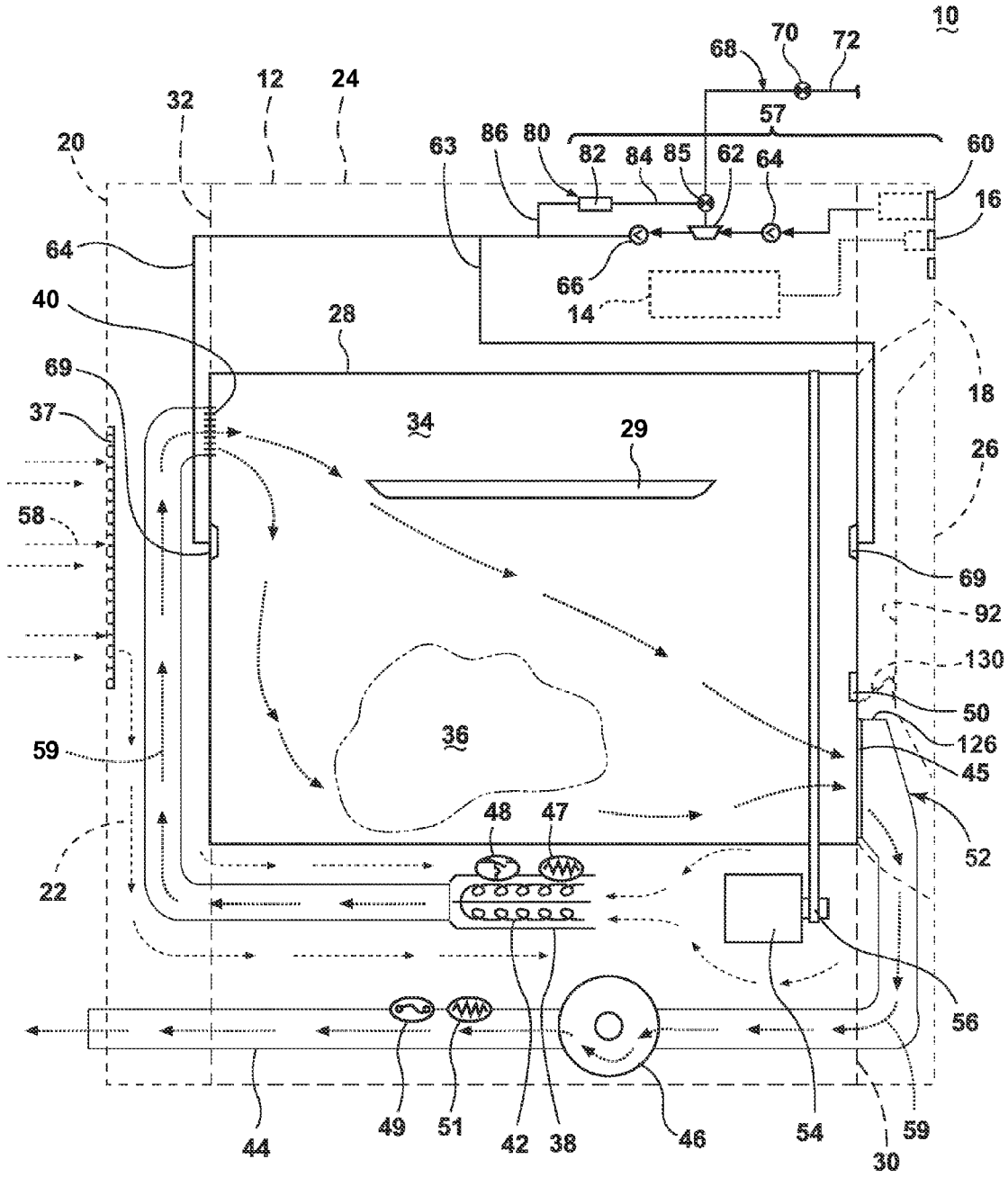
FIG. 1 is a schematic view of a laundry treating appliance in the form of a clothes dryer having a clothes dryer door.

FIG. 1 is a schematic view of a laundry treating appliance 10 in the form of a clothes dryer according to one embodiment of the invention. The clothes dryer 10 described herein shares many features of a known automatic clothes dryer, which is not described in detail except as necessary for a complete understanding of the invention. While the embodiments of the invention are described in the context of a clothes dryer, the embodiments of the invention may be used with any type of laundry treating appliance, non-limiting examples of which include a washing machine, a combination washing machine and dryer and a refreshing/revitalizing machine.

As illustrated in FIG. 1, the clothes dryer 10 may include a cabinet 12 in which may be provided a controller 14 that may receive input from a user through a user interface 16 for selecting a cycle of operation and controlling the operation of the clothes dryer 10 to implement the selected cycle of operation. Non-limiting examples of laundry that may be treated according to a cycle of operation include, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be treated in the clothes dryer 10.

The cabinet 12 may be defined by a front wall 18, a rear wall 20, and a pair of side walls 22 supporting a top wall 24. A chassis (not shown) may be provided with the walls being panels mounted to the chassis. A door 26 may be hingedly mounted to the front wall 18 and may be selectively movable between opened and closed positions to close an opening in the front wall 18, which provides access to the interior of the cabinet 12.

A rotatable drum 28 may be disposed within the interior of the cabinet 12 between opposing stationary front and rear bulkheads 30, 32, which, along with the door 26, collectively define a treating chamber 34 for treating laundry. As illustrated, and as may be the case with most clothes dryers, the treating chamber 34 may not be fluidly coupled to a drain. Thus, any liquid introduced into the treating chamber 34 may not be removed merely by draining.

The drum 28 may include at least one lifter 29. In most dryers, there may be multiple lifters. The lifters may be located along an inner surface of the drum 28 defining an interior circumference of the drum 28. The lifters 29 may facilitate movement of a laundry load 36 within the rotating drum 28.

The drum 28 may be operably coupled with a motor 54 to selectively rotate the drum 28 during a cycle of operation. The coupling of the motor 54 to the drum 28 may be direct or indirect. As illustrated, an indirect coupling may include a belt 56 coupling an output shaft of the motor 54 to a wheel/pulley on the drum 28. Alternatively, the output shaft of the motor 54 may be directly coupled to a hub of the drum 28.

An air system may be provided to the clothes dryer 10. The air system may supply air to the treating chamber 34 and may exhaust air from the treating chamber 34 through appropriate airflow portals. The supplied air may be heated or not. The air system may have an air supply portion that may form, in part, a supply conduit 38, which may have one end open to ambient air via a rear vent 37 and another end fluidly coupled to an inlet airflow portal 40 having an inlet grille, which may be in fluid communication with the treating chamber 34. A heating element 42 may lie within the supply conduit 38 and may be operably coupled to and controlled by the controller 14. If the heating element 42 may be turned on, the supplied air may be heated prior to entering the drum 28.

The air system may further include an air exhaust portion that may be formed in part by an exhaust conduit 44. An outlet airflow portal 45 having an outlet grille may fluidly couple the treating chamber 34 to the exhaust conduit 44. As illustrated, the outlet airflow portal 45 and outlet grille may be formed within a lint trap 52 having an upper flat surface 126 through which a lint filter (not shown) may be inserted/removed for filtering/cleaning. A blower 46 may be fluidly coupled to the exhaust conduit 44. The blower 46 may be operably coupled to and controlled by the controller 14. Operation of the blower 46 may draw air into the treating chamber 34 as well as exhaust air from the treating chamber 34 through the exhaust conduit 44. The exhaust conduit 44 may be fluidly coupled with a household exhaust duct (not shown) for exhausting the air from the treating chamber 34 to outside of the clothes dryer 10.

The air system may further include various sensors and other components, such as a thermistor 47 and a thermostat 48, which may be coupled to the supply conduit 38 in which the heating element 42 may be positioned. The thermistor 47 and the thermostat 48 may be operably coupled to each other. Alternatively, the thermistor 47 may be coupled to the supply conduit 38 at or near the inlet airflow portal 40 and inlet grille. Regardless of its location, the thermistor 47 may be used to aid in determining an inlet temperature. A second thermistor 51 and a thermal fuse 49 may be coupled to the exhaust conduit 44, with the thermistor 51 being used to determine an outlet air temperature.

A moisture sensor 50 may be positioned in the interior of the treating chamber 34 to monitor the amount of moisture of the laundry in the treating chamber 34. One example of a moisture sensor 50 may be a conductivity strip. The moisture sensor 50 may be operably coupled to the controller 14 such that the controller 14 receives output from the moisture sensor 50. The moisture sensor 50 may be mounted at any location in the interior of the dispensing dryer 10 such that the moisture sensor 50 may be able to accurately sense the moisture content of the laundry. For example, the moisture sensor 50 may be coupled to one of the bulkheads 30, 32 of the drying chamber 34 by any suitable means.

A dispensing system 57 may be provided to the clothes dryer 10 to dispense one or more treating chemistries to the treating chamber 34 according to a cycle of operation. As illustrated, the dispensing system 57 may be located in the interior of the cabinet 12 although other locations are also possible. The dispensing system 57 may be fluidly coupled to a water supply 68. The dispensing system 57 may be further coupled to the treating chamber 34 through one or more nozzles 69. As illustrated, nozzles 69 are provided at the front and rear of the treating chamber 34 to provide the treating chemistry or liquid to the interior of the treating chamber 34, although other configurations are also possible. The number, type and placement of the nozzles 69 are not germane to the invention.

As illustrated, the dispensing system 57 may include a reservoir 60, which may be a cartridge, for a treating chemistry that may be releasably coupled to the dispensing system 57, which dispenses the treating chemistry from the reservoir 60 to the treating chamber 34. The reservoir 60 may include one or more cartridges configured to store one or more treating chemistries in the interior of cartridges.

A mixing chamber 62 may be provided to couple the reservoir 60 to the treating chamber 34 through a supply conduit 63. Pumps such as a metering pump 64 and delivery pump 66 may be provided to the dispensing system 57 to selectively supply a treating chemistry and/or liquid to the treating chamber 34 according to a cycle of operation. The water supply 68 may be fluidly coupled to the mixing chamber 62 to provide water from the water source to the mixing chamber 62. The water supply 68 may include an inlet valve 70 and a water supply conduit 72. It may be noted that, instead of water, a different treating chemistry may be provided from the exterior of the clothes dryer 10 to the mixing chamber 62.

The treating chemistry may be any type of aid for treating laundry, non-limiting examples of which include, but are not limited to, water, fabric softeners, sanitizing agents, de-wrinkling or anti-wrinkling agents, and chemicals for imparting desired properties to the laundry, including stain resistance, fragrance (e.g., perfumes), insect repellency, and UV protection.

The dryer 10 may also be provided with a steam generating system 80 which may be separate from the dispensing system 57 or integrated with portions of the dispensing system 57 for dispensing steam and/or liquid to the treating chamber 34 according to a cycle of operation. The steam generating system 80 may include a steam generator 82 fluidly coupled with the water supply 68 through a steam inlet conduit 84. A fluid control valve 85 may be used to control the flow of water from the water supply conduit 72 between the steam generating system 80 and the dispensing system 57. The steam generator 82 may further be fluidly coupled with the one or more supply conduits 63 through a steam supply conduit 86 to deliver steam to the treating chamber 34 through the nozzles 69. Alternatively, the steam generator 82 may be coupled with the treating chamber 34 through one or more conduits and nozzles independently of the dispensing system 57.

The steam generator 82 may be any type of device that converts the supplied liquid to steam. For example, the steam generator 82 may be a tank-type steam generator that stores a volume of liquid and heats the volume of liquid to convert the liquid to steam. Alternatively, the steam generator 82 may be an in-line steam generator that converts the liquid to steam as the liquid flows through the steam generator 82.

It may be understood that the details of the dispensing system 57 and steam generating system 80 are not germane to the embodiments of the invention and that any suitable dispensing system and/or steam generating system may be used with the dryer 10. It may also be within the scope of the invention for the dryer 10 to not include a dispensing system or a steam generating system.

Figure 2:
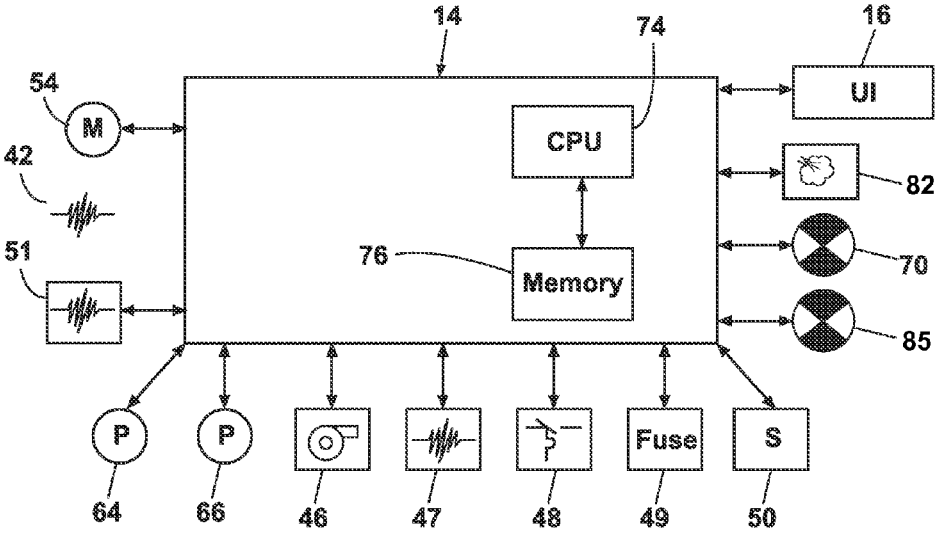
FIG. 2 is a schematic view of a controller and user interface for incorporation into the clothes dryer of FIG. 1.

FIG. 2 is a schematic view of the controller 14 coupled to the various components of the dryer 10. The controller 14 may be communicably coupled to components of the clothes dryer 10 such as the heating element 42, blower 46, thermistor 47, thermostat 48, thermal fuse 49, thermistor 51, moisture sensor 50, motor 54, inlet valve 70, pumps 64, 66, steam generator 82 and fluid control valve 85 to control these components and/or receive their input for use in controlling the components. The controller 14 may also be operably coupled to the user interface 16 to receive input from the user through the user interface 16 for the implementation of the drying cycle and provide the user with information regarding the drying cycle.

The user interface 16 may be provided having operational controls such as dials, lights, knobs, levers, buttons, switches, and displays enabling the user to input commands to the controller 14 and receive information about a treatment cycle from components in the clothes dryer 10 or via input by the user through the user interface 16. The user may enter many different types of information, including, without limitation, cycle selection and cycle parameters, such as cycle options. Any suitable cycle may be used. Non-limiting examples include, Casual, Delicate, Super Delicate, Heavy Duty, Normal Dry, Damp Dry, Sanitize, Quick Dry, Timed Dry, and Jeans.

The controller 14 may implement a treatment cycle selected by the user according to any options selected by the user and provide related information to the user. The controller 14 may also comprise a central processing unit (CPU) 74 and an associated memory 76 where various treatment cycles and associated data, such as look-up tables, may be stored. One or more software applications, such as an arrangement of executable commands/instructions may be stored in the memory and executed by the CPU 74 to implement the one or more treatment cycles.

In general, the controller 14 may effect a cycle of operation to effect a treating of the laundry 36 in the treating chamber 34. The controller 14 may actuate the blower 46 to draw an inlet airflow 58 into the supply conduit 38 through the rear vent 37 when airflow may be needed for a selected treating cycle. The controller 14 may activate the heating element 42 to heat the inlet airflow 58 as it passes over the heating element 42, with the heated air 59 being supplied to the treating chamber 34. The heated air 59 may be in contact with the laundry load 36 as it passes through the treating chamber 34 on its way to the exhaust conduit 44 to effect a moisture removal of the laundry. The heated air 59 may exit the treating chamber 34, and flow through the blower 46 and the exhaust conduit 44 to the outside of the clothes dryer 10. The controller 14 may continue the cycle of operation until completed. If the cycle of operation includes drying, the controller 14 may determine when the laundry load 36 may be dry. The determination of a "dry" load may be made in different ways, but may often be based on the moisture content of the laundry, which may be typically set by the user based on the selected cycle, an option to the selected cycle, or a user-defined preference.

Referring back to FIG. 1, the door 26 may have a deflector 130 that is located in juxtaposition with the outlet airflow portal 45 and outlet grille to deter laundry tumbling in the treating chamber from piling up against the outlet grille. More particularly, in the case where the outlet airflow portal 45 and outlet grille may be formed in the lint trap 52, the deflector 130 may be located in juxtaposition with the upper flat surface 126 to deter laundry from resting on the upper flat surface, and draping over and overlying a part of the outlet grille.

Figure 3:
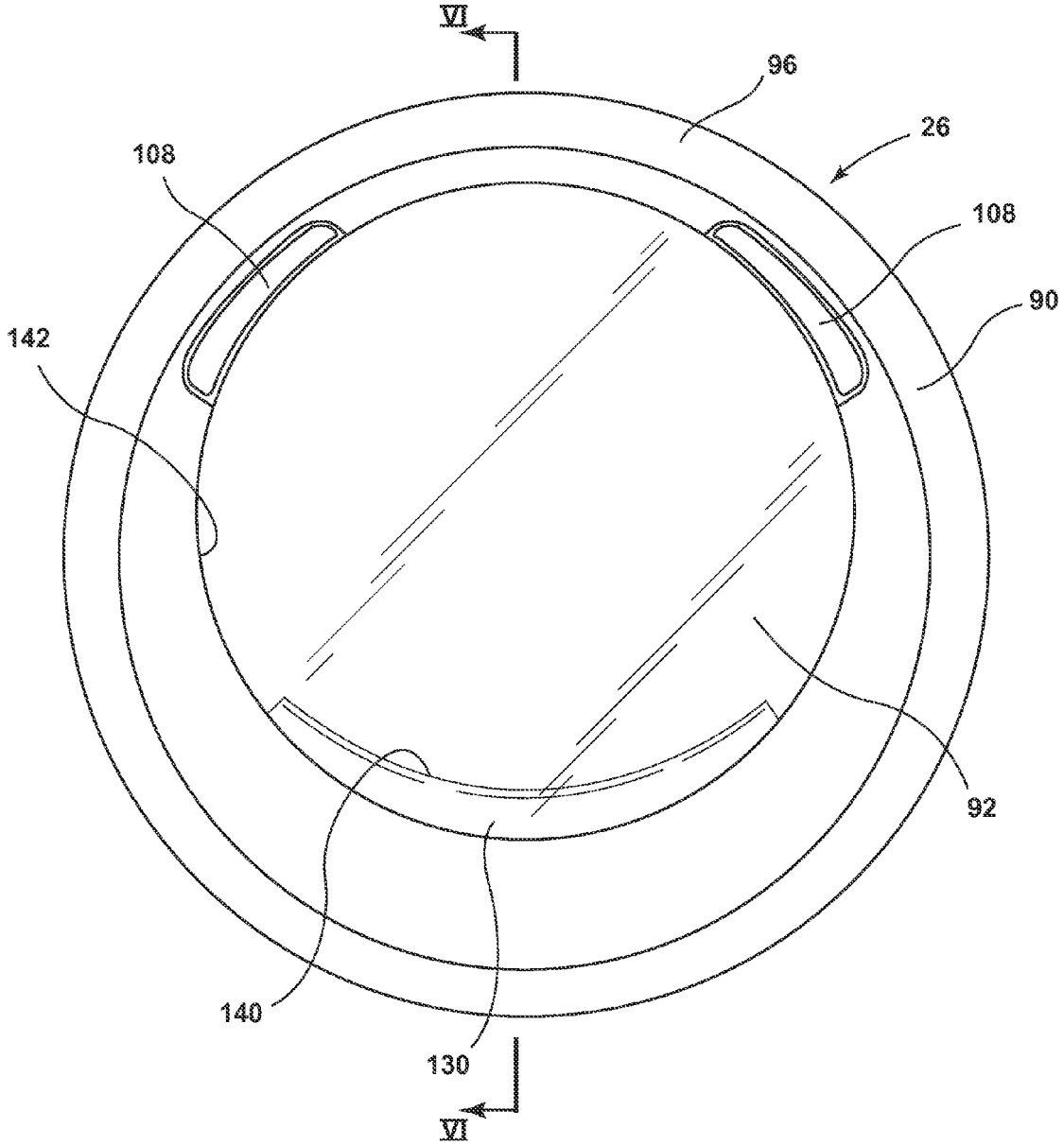
FIG. 3 is a front elevation view of the clothes dryer door including a laundry deflector according to a first embodiment of the invention.

The use of the deflector 130 may be beneficial in a dryer door having a flat rear surface which may be better understood after a full description of the door 26 and deflector 130. Referring to FIG. 3, the door 26 may include a frame 90 surrounding a flat panel 92. The frame 90 is illustrated in the present embodiment as generally circular to accommodate a corresponding structure (not shown) on the cabinet 12, but it may be understood that the frame 90 may be any suitable shape, such as elliptical, octagonal, or generally rectangular to cover most or all of the front wall 18 of the cabinet 12. The frame 90 may be provided with one or more handles 108, illustrated as recesses, for grasping by a user to open and close the door 26.

Figure 4:
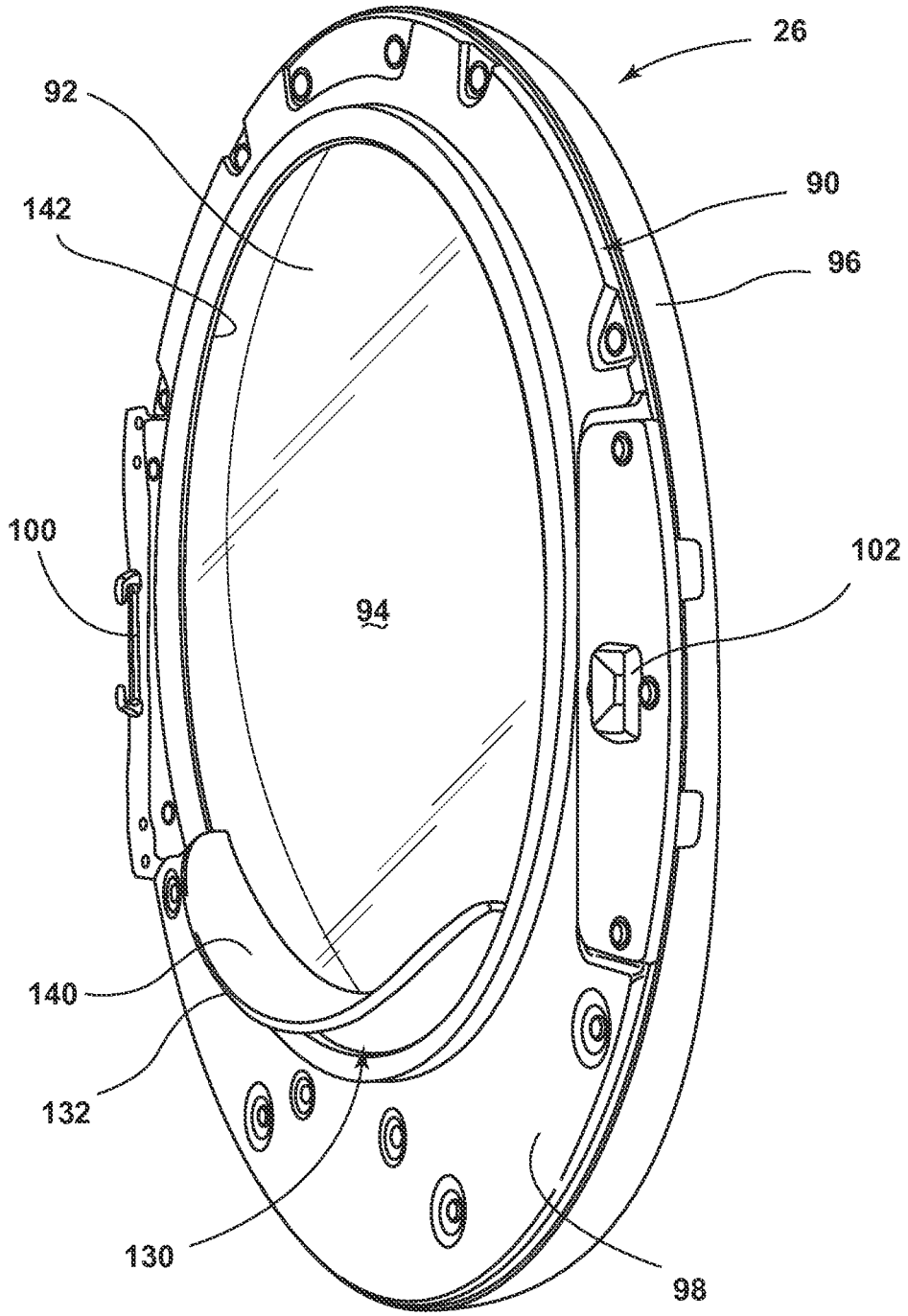
FIG. 4 is a rear perspective view of the clothes dryer door including the laundry deflector illustrated in FIG. 3.

Referring also to FIG. 4, the frame 90 may be a single element, or may include an outer trim element 96 and an inner trim element 98 which are joined together to define a ring-shaped frame having an inner edge 142, with the panel 92 held therebetween. The trim elements 96, 98 may be permanently joined, such as by welding, adhesives, and the like, or joined to enable disassembly of the frame 90 by suitable removable fasteners, such as threaded fasteners, interference fit and press fit fasteners, and the like. The frame 90 may be configured on one side with a hinge mount 100 to receive a hinge assembly (not shown) for movably mounting the door 26 to the cabinet 12, and may support a latch 102 on the diametrically opposite side for securing the door 26 to the cabinet 12 in a closed configuration.

The panel 92 may be a substantially translucent or transparent planar glass element, having a planar inner surface 94, to enable a user to view the interior of the treating chamber 34 when the door 26 may be closed. Alternatively, the panel 92 may be opaque. It is within the scope of the invention for the panel 92 to have any suitable shape, such as circular, elliptical, octagonal, and the like, complementary to the shape of the door 26. Further, the orientation of the panel 92 relative to the closed door 26 may be vertical, or may be inclined somewhat from vertical.

The deflector 130 may be associated with the planar surface 94 of the panel 92, and may extend from a rear side of the door 26, i.e., the side of the door 26 facing the treating chamber 34 when the door 26 may be closed, over the outlet airflow portal 45 and outlet grille located adjacent a lower portion of the door 26 where the treating chamber 34 transitions to the exhaust conduit 44.

Figure 5:
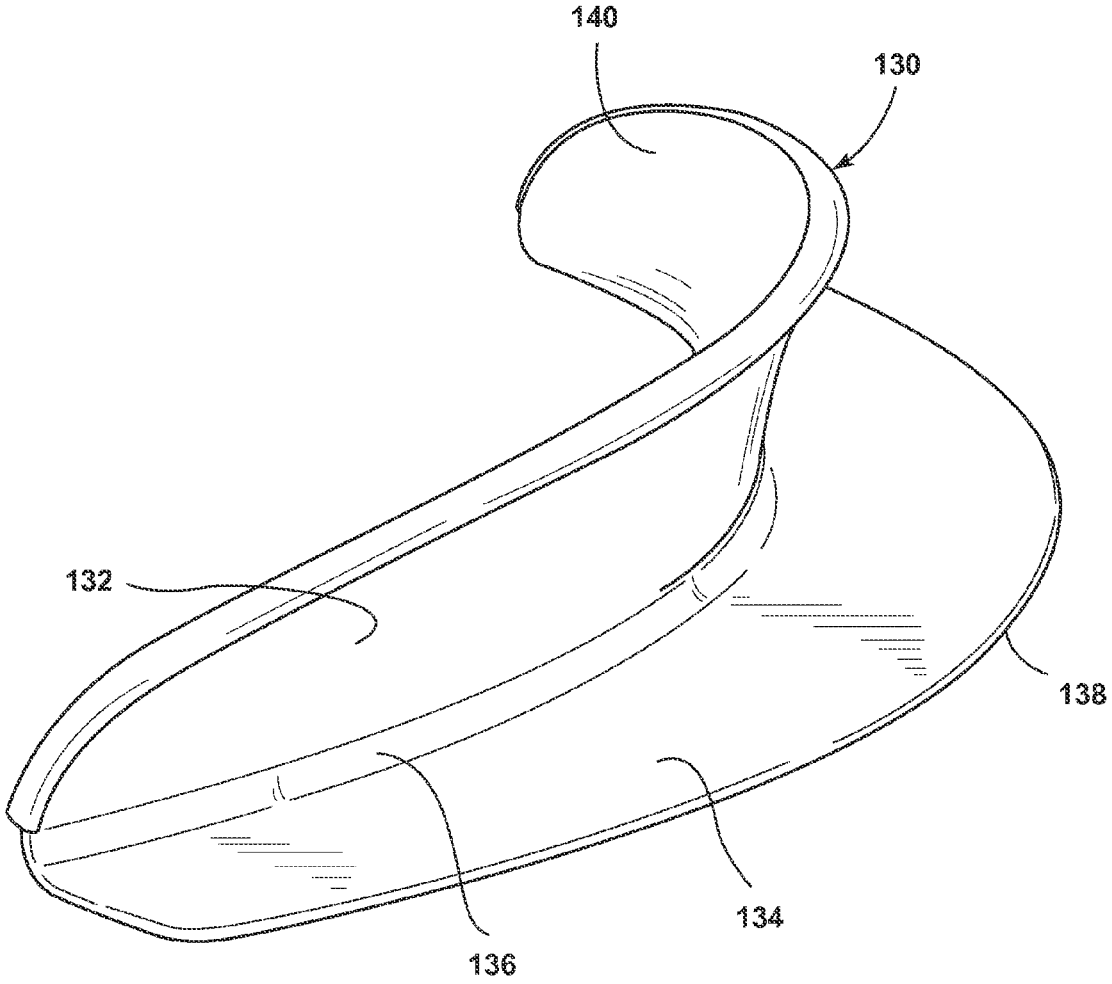
FIG. 5 is an enlarged perspective view of the laundry deflector illustrated in FIGS. 3 and 4.

As illustrated in FIG. 5, the deflector 130 may be a curved body having an arcuate deflection flange 132 extending at an angle away from an arcuate attachment flange 134 along a curved intersection 136. The curved intersection 136 may have a curvature complementary with the curvature of the inner edge 142. The arcuate deflection flange 132 may have an arcuate deflection surface 140. The arcuate attachment flange 134 may have a planar surface 138 for contact with the panel planar surface 94. While the deflector 130 is shown as being curved to complement the shape of the door 26 and/or the panel 92, the deflector 130 need not be curved to function as desired.

The deflector 130 may be mounted to the panel 92 by an adhesive applied to one or both of the planar surfaces 94, 138. Alternatively, the deflector 130 may be held between the surface 94 of the panel 92 and the inner trim element 98, mounted to the inner trim element 98, or integrally formed with the inner trim element 98 or with the panel 92. The length of the arcuate deflection flange 132 perpendicular to the arcuate attachment flange 134 may be adapted to extend a selected distance over the airflow portal 110 when the door 26 is closed.

Figure 6:
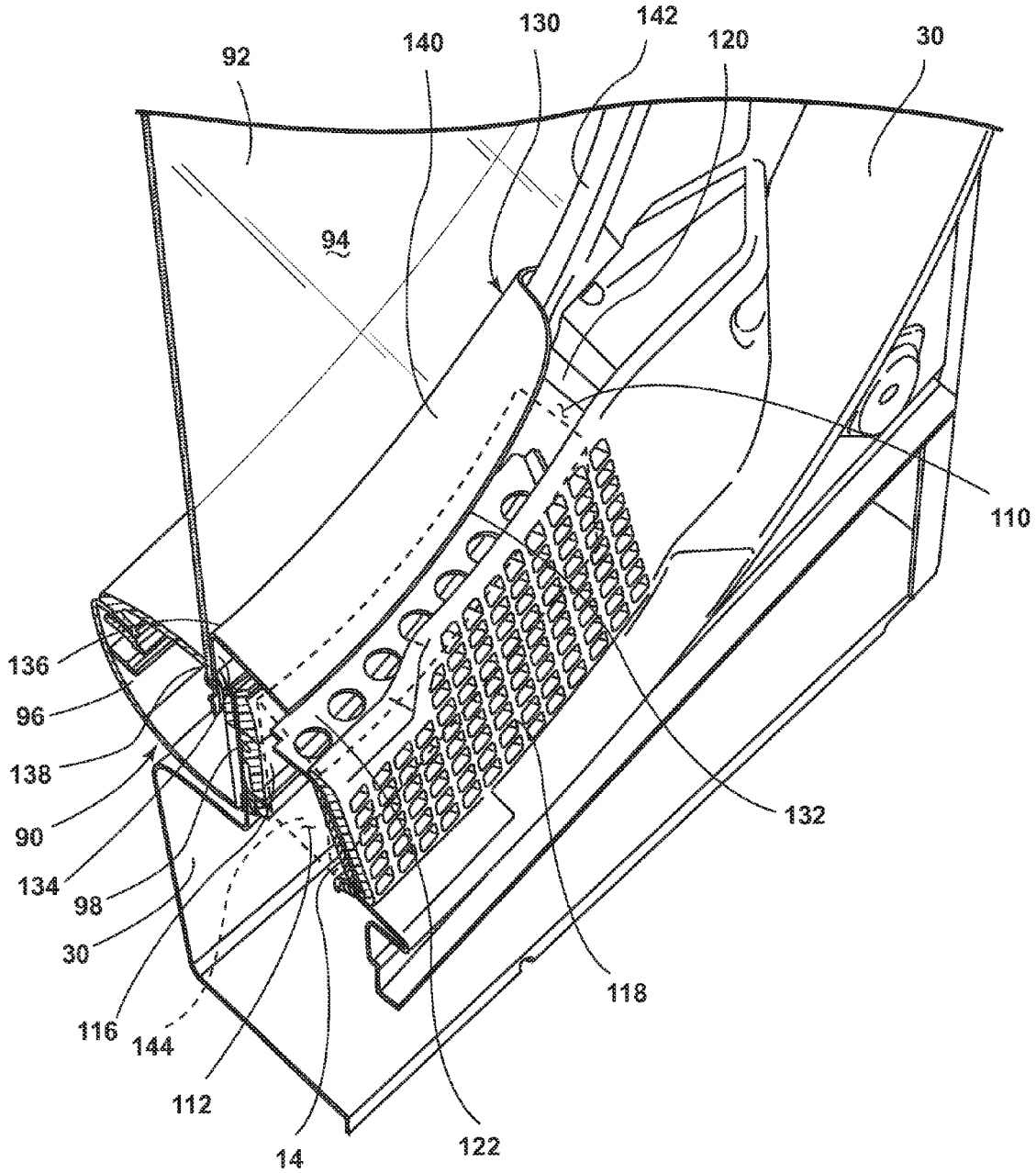
FIG. 6 is a sectional view taken along view line VI-VI of FIG. 3.

As illustrated in FIG. 6, a lower portion of the door 26 may have the deflector 130 sandwiched between the inner frame element 98 and the panel 92. The airflow portal 110 may be part of a lint trap 112 into which a filter element 144 (illustrated in phantom) may be seated. The lint trap 112 may have a rear wall 116 generally parallel with the panel 92 and forming a portion of the inner trim element 98, and an opposing grid wall 118 spaced somewhat away from the rear wall 116 and panel 92. The lint trap 112 may also have a pair of opposed side walls 120 joining the rear wall 116 with the grid wall 118 to define the lint trap 112. The deflection surface 140 may extend over the lint trap 112 terminating at or near the grid wall 118. It may be understood that the deflection surface 140 may extend beyond the grid wall 118 toward the treating chamber 34. In this configuration, the laundry load 36 may undergo tumbling and drying within the treating chamber 34 and may be drawn to the airflow portal 110 as air passes through the grid wall 118 and around the deflection surface 140. Items drawn to the airflow portal 110 may be deflected into the treating chamber 34 by the arcuate deflection surface 140 of the deflection flange 132. Movement of items of laundry 36 down the planar surface 94 of the panel 92 and across the deflection surface 140 may also tend to move items of laundry 36 away from the grid wall 118 as the items of laundry fall off the deflection surface 140 and travel downward along the grid wall 118.

Figure 7:
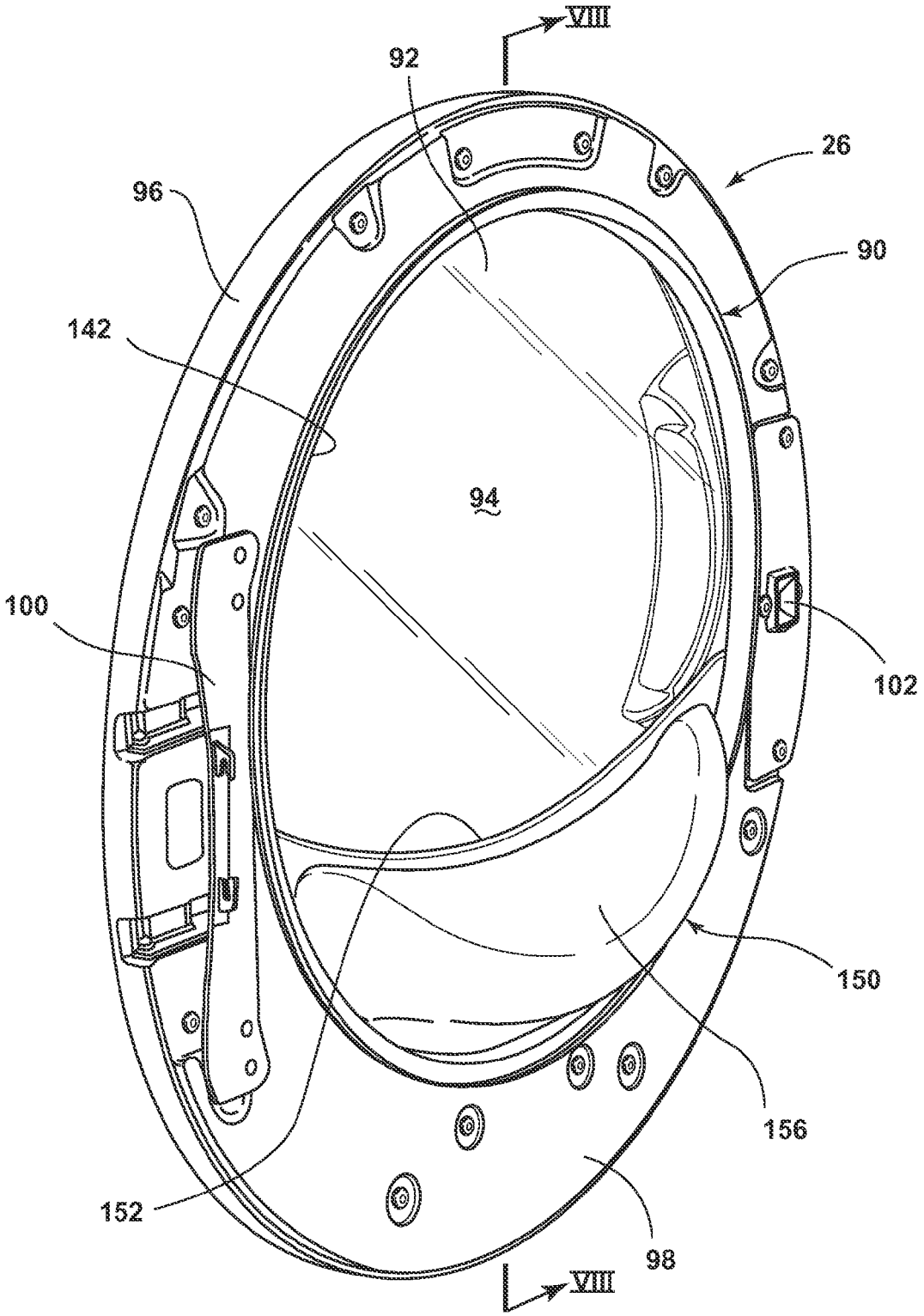
FIG. 7 is a rear perspective view of the clothes dryer door including a laundry deflector according to a second embodiment of the invention.
Figure 8:
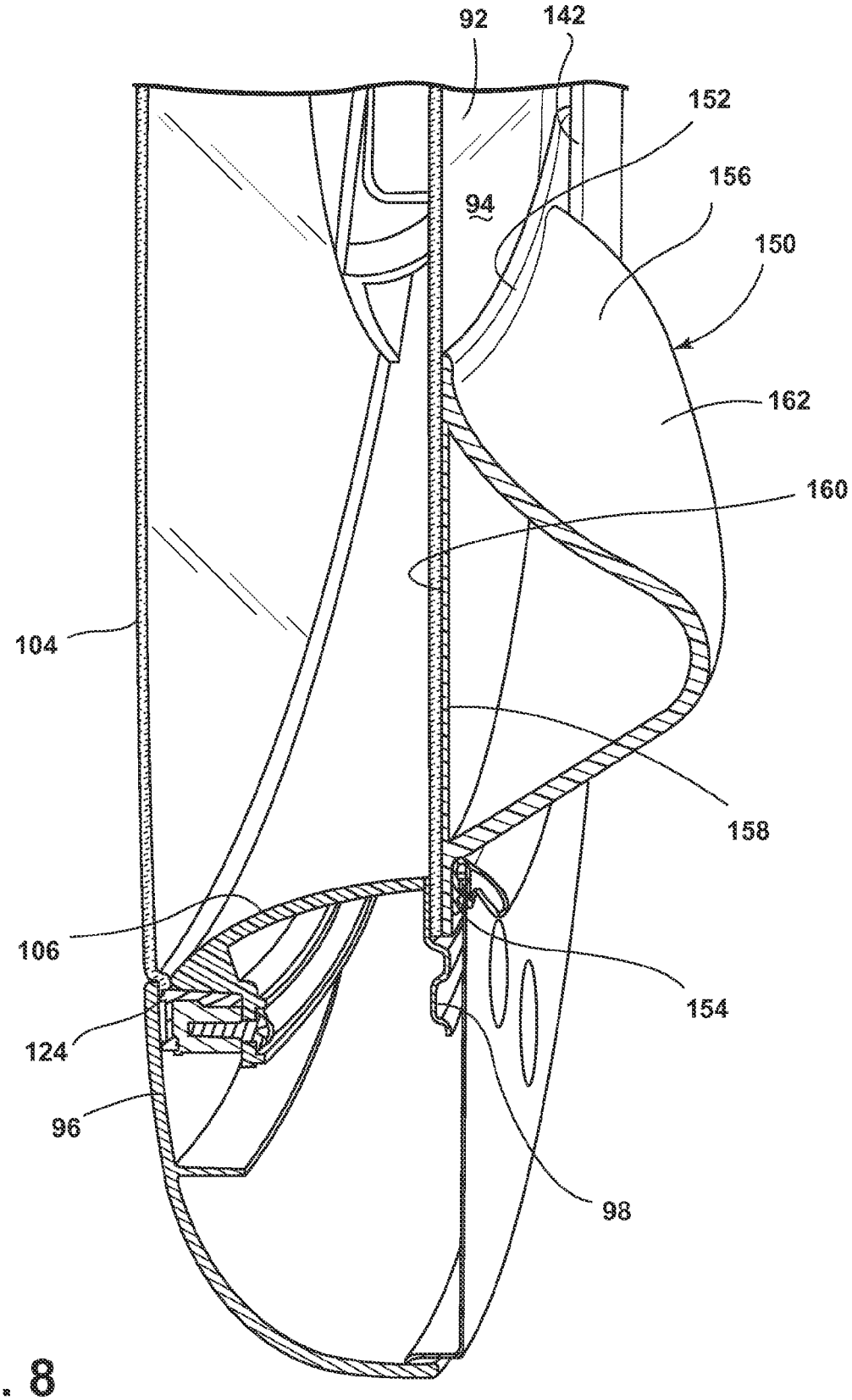
FIG. 8 is a sectional view taken along view line VIII-VIII of FIG. 7.

FIG. 7 illustrates a second embodiment of the invention comprising an extended profile deflector 150 extending away from the rear surface of the door 26. The deflector 150 may be an arcuate body occupying a somewhat greater portion of the panel 92 than the deflector 130. The deflector 150 may have a deflector shield 156 defining an arcuate surface 162 integrated with a base wall 158 having a planar surface 160. The base wall 158 may follow the curvature of the deflector shield 156, and may extend beyond the deflector shield 156 to define a concave flange 152 and a convex flange 154. As illustrated in FIG. 8, the deflector shield 156 may have a somewhat triangular or "tent-shaped" cross-section.

In a manner similar to that for the deflector 130, the extended profile deflector 150 may be attached to the panel 92 by an adhesive applied to one or both of the planar surfaces 94, 160. Alternatively, the deflector 150 may be integrated with a perimeter window gasket (not shown) between the inner trim element 98 and the panel 92, held along the convex flange 154 between the surface 94 of the panel 92 and the inner trim element 98, mounted to the inner trim element 98, or integrally formed with the inner trim element 98 or with the panel 92. The depth of the deflector shield 156 perpendicular to the base wall 158 may be adapted to extend a selected distance over the airflow portal 110 when the door 26 is closed. Alternatively, the base wall 158 may be omitted so that only the flanges 152, 154 remain.

The shape of the extended profile deflector 150 may enhance the downward movement of laundry items along the panel and into the treating chamber 34. The lower portion of the deflector shield 156 may be adapted to extend over the airflow portal 110 from the panel 92, similar to the deflection flange 132, while the upper portion of the arcuate surface 162 may be adapted with a steeper slope to facilitate movement of items of laundry 36 into the treating chamber 34.

Referring to FIG. 8, an outer panel 104 may be included to provide a dual panel door, and thereby reduce the potential for contact with the panel 92. The outer panel 104 is shown in FIG. 8 as outwardly convex; alternatively, the outer panel 104 may be planar, or have an alternate selected shape. The outer panel 104 is shown in FIG. 8 as part of the door 26 incorporating the second embodiment of the deflector 150. However, the outer panel 104 may be part of the door 26 incorporating the first embodiment of the deflector 130, the outer panel 104 incorporated into either door 26 in a similar manner. The dual panel door may include essentially all the elements of the door shown in FIGS. 3 and 4, with the exception of a modified outer trim element, a spacer 106, and the outer panel 104. The frame may include an outer trim element 96 and an inner trim element 98 separated by a spacer ring 106. The outer panel 104 may include a perimeter flange 124 to facilitate seating of the panel 104 in the frame, and may be transparent, translucent, or opaque.

A circumferential channel may be provided between the outer trim element 96 and the spacer ring 106 for holding the panel 104 in the frame. The channel may be part of the outer trim element 96, the spacer ring 106, or both, configured so that the perimeter flange 124 may be "sandwiched" between the outer trim element 96 and the spacer ring 106 when the outer trim element 96 and spacer ring 106 are joined together. Two or more of the outer trim element 96, inner trim element 98, and spacer ring 106 may be permanently joined, such as by welding, adhesives, and the like, or joined to enable disassembly of the frame by suitable removable fasteners, such as threaded fasteners, interference fit and press fit fasteners, and the like.

Substituting a relatively small, lightweight deflector and a planar glass piece for a known convex cast glass window may provide a savings in the costs of molding a cast glass window. Furthermore, the weight of the combined deflector and plate glass panel may be less than the weight of the known convex cast glass window. Consequently, the door may be more efficiently manufactured. Replacement of a deflector and/or panel may also be less costly than replacement of a convex cast glass window.

While the invention has been specifically described in connection with certain specific embodiments thereof, it may be understood that this is by way of illustration and not of limitation, and the scope of the appended claims should be construed as broadly as the prior art will permit.

What is claimed is:

1. A laundry treating appliance for treating a laundry load according to at least one cycle of operation, the appliance comprising:

a rotatable drum defining a treating chamber and including an open face through which access is provided to the treating chamber;

an air system supplying air to and exhausting air from the treating chamber and including an airflow portal adjacent the open face and in fluid communication with the treating chamber; and a door selectively movable to close the open face, the door including a panel with an interior surface facing the treating chamber when the door closes the open face, and a deflector extending away from the interior surface and at least partially overlying the airflow portal when the door closes the open face;

wherein the deflector deflects items in the laundry load away from the airflow portal when the door is closed.

2. The laundry treating appliance of claim 1 wherein the panel comprises a planar window element.

3. The laundry treating appliance of claim 2 wherein the deflector extends away from the planar window element, and toward the treating chamber when the door is closed.

4. The laundry treating appliance of claim 1 wherein the panel comprises a first window element, and wherein the door further comprises a second window element spaced from the first window element, further from the treating chamber than the first window element when the door is closed.

5. The laundry treating appliance of claim 4 wherein the door further comprises a spacer located between the second window element and the first window element.

6. The laundry treating appliance of claim 5 wherein the second window element is at least one of planar or outwardly convex.

7. The laundry treating appliance of claim 6 wherein at least one of the first window element or the second window element is vertically oriented.

8. The laundry treating appliance of claim 1 wherein the panel comprises a window element, and wherein the door further comprises an outer trim element and an inner trim element, which are mounted together and retain the window element between the outer and inner trim elements.

9. The laundry treating appliance of claim 8 wherein the deflector is at least one of integrally formed with the inner trim element, or retained between the inner and outer trim elements.

10. The laundry treating appliance of claim 9 wherein a handle is formed in the outer trim element.

11. The laundry treating appliance of claim 10 wherein the handle comprises a recess formed in the outer trim element.

12. The laundry treating appliance of claim 1 wherein the air system comprises a filter element that is insertable through the airflow portal.

13. The laundry treating appliance of claim 12 wherein the air system comprises a treating chamber inlet upstream of the airflow portal.

14. The laundry treating appliance of claim 12 wherein the deflector at least partially overlies the filter element when the filter element is inserted into the airflow portal and the door closes the open face.

15. The laundry treating appliance of claim 1 wherein a portion of the deflector extends through the open face when the door closes the open face.

16. The laundry treating appliance of claim 15 wherein the portion of the deflector is located on a lower portion of the interior surface.

17. The laundry treating appliance of claim 1 wherein the deflector has an arcuate shape.

18. The laundry treating appliance of claim 1 wherein the deflector is positioned at a lower portion of the door.

19. The laundry treating appliance of claim 1 wherein the deflector is adhered to the interior surface.

20. The laundry treating appliance of claim 1 wherein the deflector comprises at least one of a triangular or tent-shaped cross-section.

* * * * *